United States Patent [19]

Luchonok et al.

[11] Patent Number: 4,935,978

[45] Date of Patent: Jun. 26, 1990

[54] WEDGE CUT WATERBED MATTRESS

[75] Inventors: Jeffrey J. Luchonok, Torrance; Charles P. Hall, Santa Rosa, both of Calif.

[73] Assignee: Advanced Sleep Products, Carson, Calif.

[21] Appl. No.: 405,449

[22] Filed: Sep. 11, 1989

[51] Int. Cl.[5] ..... A47C 27/08

[52] U.S. Cl. ..... 5/451; 5/449

[58] Field of Search ..... 5/451, 450, 449, 422, 5/452, 431, 457; D6/604

[56] References Cited

U.S. PATENT DOCUMENTS

| | | | |
|---|---|---|---|
| 1,382,531 | 6/1921 | Newborn | 5/449 |
| 1,432,875 | 10/1922 | Lauagetto | 5/431 |
| 4,127,908 | 12/1978 | Colwell | 5/451 |
| 4,611,357 | 9/1986 | Chelin | 5/451 |

FOREIGN PATENT DOCUMENTS

| | | | |
|---|---|---|---|
| 228745 | 1/1959 | Australia | 5/464 |

*Primary Examiner*—Alexander Grosz

*Attorney, Agent, or Firm*—Kinzer, Plyer, Dorn, McEachran & Jambor

[57] ABSTRACT

A waterbed mattress comprises an inflatable container formed of a flexible plastic material with a generally planar top sleeping surface and a generally planar bottom. There are generally vertical side walls and a generally vertical head end wall and a generally vertical foot end wall. the head end wall has a greater vertical height than that of the foot end wall whereby the top sleeping surface slants from the head end to the foot end.

2 Claims, 1 Drawing Sheet

Fig. 1.
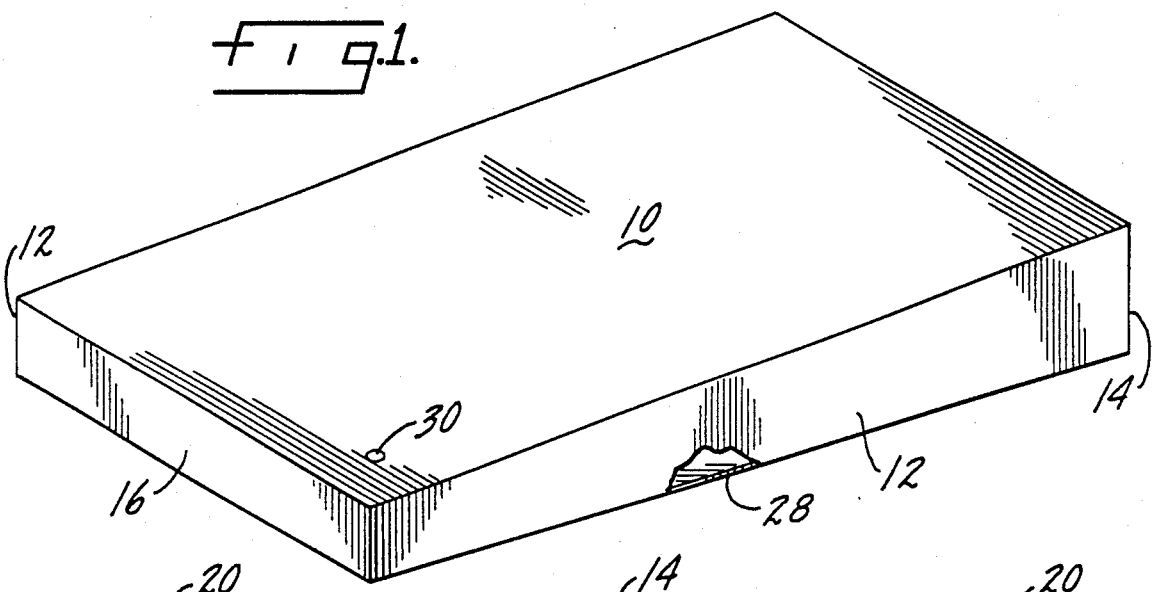
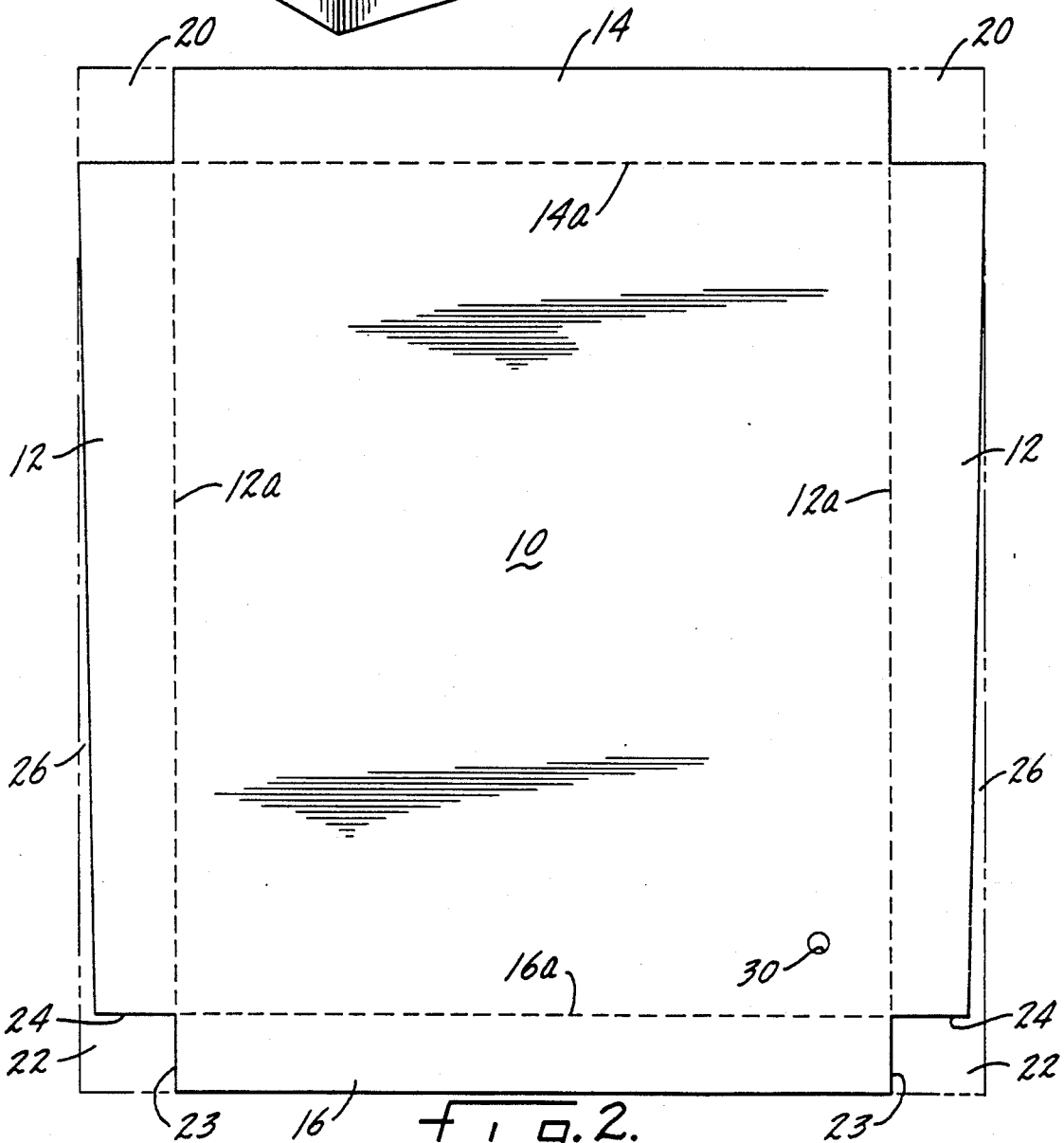
Fig. 2.

WEDGE CUT WATERBED MATTRESS

SUMMARY OF THE INVENTION

The present invention relates to waterbed mattresses and in particular to a waterbed mattress which has reduced surface tension and particularly less surface tension at the head end than at the foot end.

A primary purpose of the invention is to provide a reduced surface tension water mattress in which the mattress has a greater depth at the head end than at the foot end.

Another purpose is a waterbed mattress of the type described in which the top sleeping surface uniformly and gradually slants from the head end to the foot end.

Another purpose is a waterbed mattress which provides less support at the head end of the mattress than at the foot end whereby the shoulders and head of an individual on the mattress will sink to a greater depth than the middle and lower body extremities.

Another purpose is to provide a waterbed mattress which is simple in construction, reliable in manufacture and which provides reduced surface tension by having a generally slanted top sleeping surface.

Other purposes will appear in the ensuing specification, drawings and claims.

BRIEF DESCRIPTION OF THE DRAWINGS

The invention is illustrated diagrammatically in the following drawings wherein:

FIG. 1 is a perspective of a waterbed mattress of the present invention, and

FIG. 2 is a diagram of the cutting plan for the top sheet of the mattress in FIG. 1.

DESCRIPTION OF THE PREFERRED EMBODIMENT

There have been various designs of waterbed mattresses which are directed to providing non-uniform or variable support for the sleeper. Such designs have included the provision of uniform and non-uniform folds in the top surface of the mattress so that the folds stretch out under the weight of a body, with the pattern of folds providing either uniform or non-uniform support for the body. One such design is shown in U.S. Pat. No. 4,583,254, assigned to the assignee of the present application. Because weight is not uniformly distributed in an individual's body, it is desirable to have a reduced surface tension for certain parts of the body, allowing those body areas to sink more deeply into the mattress than others. The present invention provides a waterbed mattress design in which there is reduced surface tension at the head end, permitting the head and shoulders to sink into the mattress to a greater degree than other parts of the body, particularly the middle and lower extremities. This result is accomplished by the use of a waterbed mattress which has a greater depth at the head end than at the foot end so that the top sleeping surface gradually slants from the head end to the foot end.

Referring to FIG. 1, a waterbed mattress has a top sleeping surface 10, generally vertical side walls 12, a generally vertical head end wall 14 and a generally vertical foot end wall 16. The sides are all generally vertical and the mattress bottom is in a plane which is perpendicular to the planes of each of the side walls. Thus, each corner is vertical and at each corner the adjacent side walls are generally perpendicular. The top slants from the head end to the foot end and the preferred construction provides a 9½" depth for the head end wall 14 and an 8" depth for the foot end wall 16.

The water mattress is formed of a flexible plastic material and a vinyl having a thickness between 20 and 22 gauge is preferred, although other types and thicknesses of flexible plastic materials may be equally satisfactory.

FIG. 2 illustrates the cutting pattern to produce the top surface, side and end walls of the mattress of FIG. 1. The top surface 10 is bounded by four fold lines, **14*a* at the head end, 16*a* at the foot end, and 12*a* along the sides. The head end corners have a cut-out area 20 which, in the illustrated example, will be 9½" on a side. The foot end corners have a cut-out area 22 which has an 8" dimension along side 23 and a total dimension of 9½" and an effective dimension of 8" along line 24 so that the actual corners at the foot end have an 8" vertical height. Along each of the side walls 12 there is a gradually tapering wedge-shaped cut-out area 26** which begins at the head end corners and gradually increases in width toward the foot end corners, with the depth of the cut-out portion being 1½" at the foot end.

In forming the mattress of FIG. 1, the top sheet is first folded along the four fold lines, after which the corners are heat sealed together. A bottom sheet 28, having the same dimensions as the top sheet 10, is then heat sealed to each of the bottom edges of the side walls 12, the head end wall 14 and the foot end wall 16. This process completes the formation of the waterbed mattress. As is conventional, there may be a fill opening 30 in the top surface.

Of particular advantage in the construction shown and described herein is the fact that there is more material at the head end of the mattress resulting in less surface tension at the head end than at the foot end. The shoulders and head of an individual or individuals lying on the mattress will then sink into the mattress a greater depth than will the foot extremities or the mid-section of the body. This provides a more comfortable feel for the person using the mattress. In use, the mattress will be completely filled with water and there will be substantially no air remaining in the mattress after filling.

As shown and described herein, the mattress does not use any of the many forms of waterbed mattress baffles or dampening devices which are currently on the market, although one or more of such devices could be included herein.

Whereas the preferred form of the invention has been shown and described herein, it should be realized that there may be many modifications, substitutions and alterations thereto.

The embodiments of the invention in which an exclusive property or privilege is claimed are defined as follows:

1. A waterbed mattress comprising an inflatable container formed of a flexible plastic material and having a generally planar top sleeping surface gradually and uniformly sloping from the head end to the foot end, a bottom surface, generally vertical side walls, each having an upper edge which gradually and uniformly slopes from the head end to the foot end, a generally vertical head end wall and a generally vertical foot end wall, the head end wall having a vertical height greater than that of the foot end wall, whereby the top sleeping surface slants from the head end to the foot end and provides less support at the head end than at the foot end, permitting the shoulders and head of an individual on the mattress to sink to a greater depth than the middle and lower body extremities, said mattress top sleeping surface, side walls, head end wall and foot end wall being formed from a single sheet of flexible plastic material, notched at the corners and with tapered sides, with the vertical ends of the side walls and end walls being heat sealed together to form corners after which the bottom surface is heat sealed, at the edges, to the bottom edges of the side walls, head end wall and foot end wall.

2. The waterbed mattress of claim 1 further characterized in that each of said generally vertical side walls has an upper edge which gradually and uniformly slopes from the head end wall to the foot end wall.

* * * * *